United States Patent [19]

Hicks

[11] 4,184,295

[45] Jan. 22, 1980

[54] SUN'S RAYS REFLECTOR AWNING

[76] Inventor: Gary D. Hicks, 140 23rd Ave. No. 45, Greeley, Colo. 80631

[21] Appl. No.: 946,630

[22] Filed: Sep. 28, 1978

[51] Int. Cl.[2] ..... F04B 1/346

[52] U.S. Cl. ..... 52/64; 52/171; 160/59

[58] Field of Search ..... 52/74, 171, 64; 49/37, 49/71; 160/60, 59

[56] References Cited

U.S. PATENT DOCUMENTS

| | | | |
|---|---|---|---|
| 231,548 | 8/1880 | Dwinelle | 160/60 |
| 752,348 | 2/1904 | Lutts | 52/74 X |
| 1,794,999 | 3/1931 | Wilhelm | 160/59 |
| 2,109,545 | 3/1938 | McGrane | 160/59 X |
| 2,521,263 | 9/1950 | Sorenson | 160/60 |
| 2,601,078 | 6/1952 | Young | 49/37 |
| 2,805,711 | 9/1957 | Mehl | 160/76 |
| 3,116,519 | 1/1964 | Keith | 49/71 X |

*Primary Examiner*—Carl D. Friedman
*Attorney, Agent, or Firm*—W. Britton Moore

[57] ABSTRACT

A reflector awning for buildings, trailers, mobile homes and other structures including a reflector frame having a transparent reflective panel mounted therein with pairs of bracket arms pivotally connected to the side frame members adjacent the upper and lower ends thereof whereby the bracket arms are so pivotally attached to a wall surface adjacent to a window frame therein and being pivotally vertically adjustable relative thereto that, when raised to elevated awning position during warm weather, the sun's rays will be reflected therefrom to cool the interior, and, when arranged at a position angularly below the window, the sun's rays will be reflected inwardly through the window to assist in heating the interior. When mounted relative to a window, viewing therethrough is not impaired.

6 Claims, 7 Drawing Figures

SUN'S RAYS REFLECTOR AWNING

This invention relates to a reflector awning pivotally and adjustably mounted relative to a window frame to enable use as an awning for reflecting the sun's rays away from the window during warm weather for interior cooling, and reflecting rays through the window to heat the interior during cold weather.

While it has heretofore been proposed to use heat reflecting assemblies for windows and vehicle windshields and the like, such as, those represented by U.S. Pat. Nos. to Chenoski 2,651,543, Parks 2,711,923, Pfeiffer 2,842,199, and Wells 2,914,075, none of such devices have been adapted for the dual function of shielding the window surface from heat in warm weather for interior cooling, and directing the sun's rays therethrough for interior heating during cold weather.

The principal object of the present invention is to provide a reflector awning with a transparent reflective panel pivotally and vertically adjustable relative to a window that, when moved to elevated awning position, the sun's rays are reflected away therefrom, and, in a lowered position, the rays are directed interiorly therethrough to selectively cool or heat the interior.

Another object is the provision of a reflector awning having two pairs of bracket arms spacedly and pivotally connected to the side frame members to enable one pair of bracket arms to be mounted relative to and intermediate a window frame, and the other bracket arms to be selectively mounted relative to either the upper or lower ends thereof whereby selective positioning of the awning thereat either reflects sun's rays therefrom or thereinto for respective cooling or heating of the interior.

Still another object is to provide a reflector awning having one pair of window frame mounting bracket arms for pivotal mounting intermediate the upper and lower ends thereof and longitudinally adjustable to enable vertical swinging adjustment of the awning either above or below the window, and another pair of bracket arms for selective mounting of the awning at either position of the awning.

A further object is the provision of a reflector awning being alternately mounted for positioning above and below a window frame for either reflecting the sun's rays away from the window for interior cooling, or thereinto for heating, and wherein either position thereof will not impair viewing through the window.

These and other objects and advantages will be apparent as the specification is considered with the accompanying drawings, wherein FIG. 1 is a perspective view of a window frame and window with the reflector awning pivotally mounted relative thereto in elevated position to reflect sun's rays therefrom;

Figure 1:
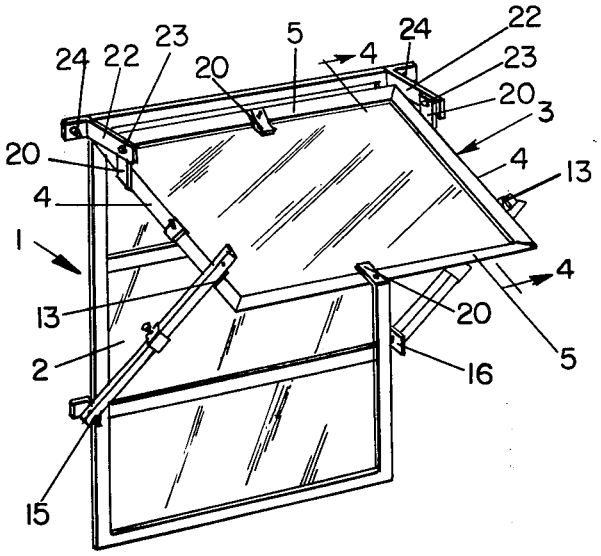

Referring more particularly to the drawings, wherein similar reference characters designate like parts throughout the several views, numeral 1 refers to a window frame which may be of any suitable material, such as metal, having a window 2 suitably swingably or slidably arranged therein. While the window frame and window may be suitably mounted in any wall surface, the present reflector awning is particularly suitable for use with metal or plastic building structures, vehicular trailers, and mobile homes and the like, not shown.

Figure 4:
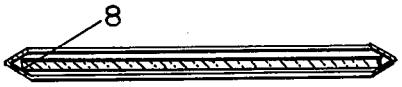
FIG. 4 is a section on the line 4–4 of FIG. 1.
Figure 5:
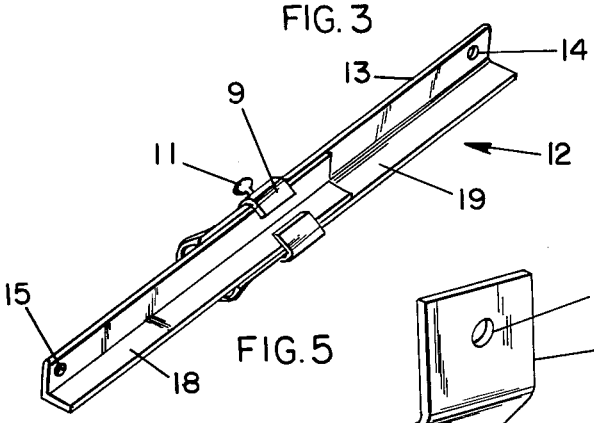
FIG. 5 is a perspective view of one of a pair of mounting bracket arms.
Figure 6:
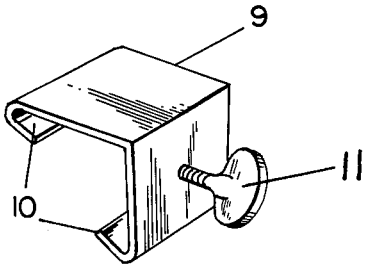
FIG. 6 is a perspective view of an awning frame clamp.

A generally rectangular awning frame 3 of any suitable material, such as aluminum or plastic, may be of the same approximate width but of somewhat lesser height than the window and window frame. Suitably mounted and contained in side 4 and top and bottom frame members 5 of frame 3 is a transparent viewing panel 6, of any suitable material, such as plexy glass, having a transparent film or panel 7 of any suitable reflective material superposed thereon. The side, top and bottom frame members 4 and 5 may be bent angularly to provide a generally V-shaped channel 8 extending therearound, as best shown in FIG. 4, to retain the panels 6 and 7 therein. The latter may be additionally retained therein by suitable V-shaped clamps 9, with inturned inner ends 10 (FIG. 6) which fit over the frame members, and locked thereto by finger adjusted set screws or the like 11.

Figure 7:
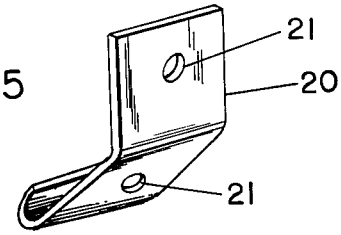
FIG. 7 is a portion of one of the other pair of mounting bracket arms.

A two-part elongated adjustable mounting angle bracket 12 is pivotally connected at one end 13 to one end of each awning side frame member, as at 14, and at its other end 15 to and L-shaped bracket clip 16 suitably anchored to the window frame, as at 17. Each angle bracket 12 includes inner and outer members 18 and 19 sleeved within each other and retainable in elongated adjusted position by a V-shaped clamp 9. Angle clips 20 (FIG. 7) are fitted over each side frame member 4 adjacent the other ends thereof and fixedly anchored thereto, as at 21, and are in turn pivotally connected, as at 23, to the outer ends of L-shaped bracket clips 22 suitably anchored, as at 24, to the wall surface or window frame, either at the top, as in FIG. 1, or at the bottom, as in FIG. 2

Figure 2:
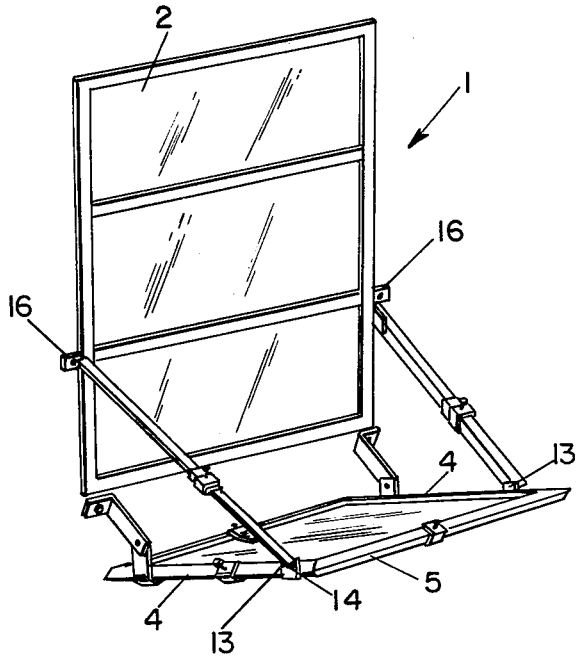
FIG. 2 is a similar view, with the reflector awning in lowered position to reflect sun's rays inwardly through the window.
Figure 3:
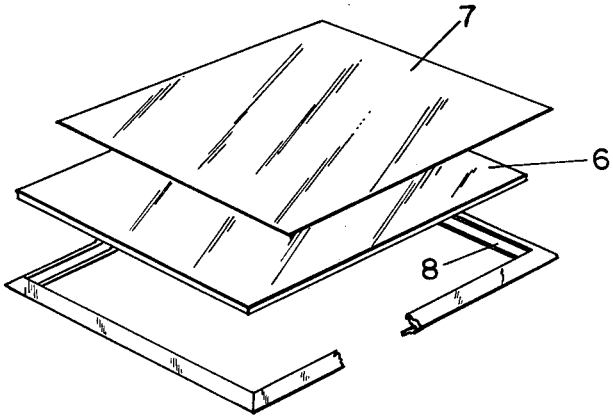
FIG. 3 is an exploded view reflector awning frame with transparent plastic and reflective material panels mountable therein.

From the foregoing, it will be apparent that when the reflector awning is mounted relative to a window in the elevated position of FIG. 1, it will project outwardly and downwardly at an angle thereover so that the reflector panel surface 7 will be uppermost and will reflect the sun's rays therefrom and tend to cool the interior. On the other hand, in cooler weather when heat is required, the bracket clips 22 will be disconnected from their upper FIG. 1 positions and the awning swung downwardly so that the clips may be reattached at the lower end of the window frame, as shown in FIG. 2. In the latter position, the awning will project outwardly and upwardly below at an angle relative to the window, with the reflector panel surface 7 uppermost, so that the sun's rays will be reflected upwardly and inwardly through the window and tend to heat the interior. The angles at which the awning may be positioned may be adjusted by loosening clamps 9, in an obvious manner. In either position thereof, as the panels are transparent, viewing therethrough will not be impaired.

When the awning is not required, it may be either entirely removed from the window, or may be folded flatly thereagainst, in an obvious manner, which may be desirable when the structure is not in use, or during transit thereof.

While a preferred embodiment has been shown and described, it is to be unerstood that various changes and improvements may be made therein, without departing from the scope and spirit of the appended claims.

What I claim is:

1. In a reflector awning assembly for a windowed structure, a frame, transparent viewing and reflector panel means arranged in said frame, first bracket means on said frame and being longitudinally adjustable for pivotally mounting said frame intermediate the ends of said window, and second bracket means on said frame for selectively mounting said frame at and angularly relative to the upper or lower ends of said window whereby said awning will project outwardly and downwardly therefrom at an angle for reflecting the sun's rays therefrom for cooling the interior of said structure, and upwardly and outwardly therefrom at an angle for reflecting rays thereinto for heating the interior, and whereby viewing through said window will not be impaired.

2. In a reflector awning, according to claim 1, wherein said first bracket means includes elongated brackets pivotally connected intermediate the sides of said frame and a window of said structure.

3. In a reflector awning, according to claim 2, wherein said second bracket means includes brackets pivotally connected to the sides of said frame spaced from said first bracket means for selectively connecting said frame angularly with reference to the upper and lower ends of a window.

4. In a reflector awning, according to claim 3, wherein said first and second bracket means are spacedly arranged in pairs at the sides of said frame.

5. In a reflector awning, according to claim 4, wherein said first bracket means includes elongated members sleeved one within the other for adjustment thereof, and said second bracket means includes clip means for pivotally connection to said frame sides.

6. In a reflector awning, according to claim 1, wherein said viewing and reflector panel means is generally rectangular and is removably mounted in said frame.

* * * * *